United States Patent [19]

Hasegawa

[11] 4,388,956

[45] Jun. 21, 1983

[54] METHOD OF PATCH MENDING A VENEER SHEET

[75] Inventor: Katsuji Hasegawa, Ohbu, Japan

[73] Assignee: Mienan Machinery Works, Inc., Ohbu, Japan

[21] Appl. No.: 236,578

[22] Filed: Feb. 20, 1981

[51] Int. Cl.[3] ..... B27G 1/00

[52] U.S. Cl. ..... 144/332; 144/2 M

[58] Field of Search ..... 144/2 R, 2 M, 330, 332

[56] References Cited

U.S. PATENT DOCUMENTS 2,336,703 12/1943 Skoog ..... 144/2 M
2,336,704 12/1943 Skoog ..... 144/2 M
3,547,170 12/1970 Maxey ..... 144/2 M

FOREIGN PATENT DOCUMENTS 710118 5/1965 Canada ..... 144/2 M

*Primary Examiner*—W. D. Bray
*Attorney, Agent, or Firm*—Armstrong, Nikaido, Marmelstein & Kubovcik

[57] ABSTRACT

A method of mending a veneer sheet having a defective portions is provided. An imcomplete veneer sheet and a sheet of mending material is laid one on top of the other. They are cut through by a single stroke of a annular cutting tool such that the defective portion of the veneer sheet is cut off whereas a plug having a same size and shape as the cut-off defective portion is cut out. They are retained in the annular cutting tool until the plug is shifted into a plane in which the veneer sheet extends. At the same time, the cut-off defective portion is removed from the veneer sheet. Then, when the cutting tool is removed from the sheets, a mended veneer sheet results.

Another method is also provided. A plurality of plugs are cut out from a sheet of mending material by repeatedly cutting through it by a single annular cutting tool. The cut-out plugs are retained in the annular tool. Then, an incomplete veneer sheet is cut through by the tool to cut off a defective portion from the veneer sheet while the plugs retained in the tool pushed farther into it. However, a plug in contact with the cut-off defective portion is pushed toward the plane in which the veneer sheet extends. As a result, the defective portion is routed out. When the annular cutting tool is removed from the sheet, the mended veneer sheet results. This can be repeated until the plugs run out.

9 Claims, 21 Drawing Figures

METHOD OF PATCH MENDING A VENEER SHEET

BACKGROUND OF THE INVENTION

The present invention relates to a method of removing local defective portions in a veneer sheet such as knotholes, dead knots, rotten spots and the like and filling the routed-out openings with defect-free patching pieces.

Various methods of the type described are known in the art as stated for instance in "PLYWOOD PRODUCTION", 2nd Edition, pp 127–131 written by Haruo Watanabe and published by Morikita Shuppan.

One of the known methods consists in cutting out a defective portion from a veneer sheet at a suitable first station and manually seating in the resulting opening of the veneer sheet a pre-shaped patch common in shape and size to the opening at a second station remote from the first station.

Another known method which is generally referred to as Reiman's method employs a sequence of mechanical actions for performing the removing operation and plugging operation of the first known method at the same station. This method compared with the first method saves a substantial amount of labor and facilitates an automatic patching process.

Such conventional methods involve a common drawback originating from the use of essentially independent punches (cutting members) for removing a defective portion and forming a patch or plug to be seated in the resultant opening. The two different punches need an identically high precision which in turn calls for such a skill for their precision control, centering at mounting positions etc. This makes it difficult to favorably keep the patch or plug seated in the hole of a veneer sheet in register therewith. Meanwhile, a patch or a plug has heretofore been inserted manually in a veneer sheet as mentioned after the removal of the defect of the veneer sheet or such a manual procedure has been simply replaced by a mechanical procedure. This gives rise to another drawback concerning the efficiency of operations. Another factor which limits the efficiency or workability is that patching is carried out only at a fixed location and a defective portion of a veneer sheet must be moved by manual work all the way to a position just below a punch. Thus, the efficiency obtainable with the conventional method is not more than the one of a patching technique with a fixed patching position.

SUMMARY OF THE INVENTION

It is an object of the present invention to provide a basic patch mending method which is applicable not only to the traditional fixed-spot patching but to patch mending at any spot on a selected line, patch mending at any spot in a selected flat or curved plane and the like while ensuring constant coincidence in shape and size of patches with removed portions of a veneer sheet. This method of the present invention improves the quality and yield of plywood and thereby contributes to the plywood production which is suffering from the supply of inferior quality logs today.

DETAILED DESCRIPTION OF THE PREFERRED EMBODIMENTS

Reference will now be made to the accompanying drawings for describing some apparatuses for practicing preferred examples of the patch mending method of the present invention.

FIGS. 1–4 illustrate an apparatus for a first example of the method according to the present invention and its operating sequence in sectional views.

Referring to FIGS. 1–4, there is shown a veneer sheet 1 having a defective portion 3 and a patch mending material or patch blank 2 from which a plug 2*a* will come out as will be described. As shown, the veneer sheet and the sheet of mending material are laid one on top of the other. While the patch blank 2 usually takes the form of a defect-free veneer sheet common in thickness to the defective veneer sheet 1, use may be made of corrugated cardboard, a plastic sheet, an ordinary board or like fiberboard if desired.

Figure 8:
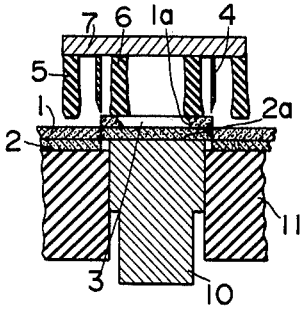
Figure 13:
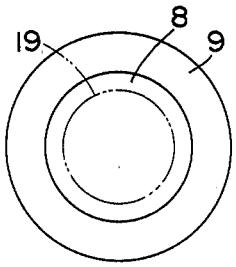
FIG. 13 is a plan view of a cutter bearing assembly of the apparatus which performs the first example of the invention.
Figure 21:
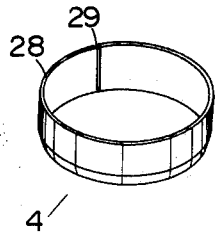
FIG. 21 is a perspective view of an annular cutter member 4.

The apparatus for patch mending the veneer sheet 1 with the patch blank 2 essentially comprises a patch mending head assembly and a cutter bearing assembly coactive therewith. The patch mending head assembly includes an annular cutting tool 4 which may have an edge line shown by way of example in "PLYWOOD PRODUCTION", FIG. 8.27 in page 131. An exemplary configuration of such a cutter is indicated in FIG. 21. Two continuous or discontinuous pressing means in the form of flexible rubber members 6 and 5 which are easily deformed under external force are arranged substantially along the inner and outer peripheries of the cutter 4 individually. These presser members 6 and 5 are securely mounted to the underside of a flat holder 7 of the patch mending head. The cutter bearing assembly on the other hand includes a cutter bearing body 8 which will be engaged by the edge of the annular cutting tool 4 and a table 9 surrounding the cutter bearing body 8. FIG. 13 illustrates the positional relationship between the cutter bearing body 8, table 9 and edge line of the cutting tool denoted by the reference numeral 19.

Figure 1:
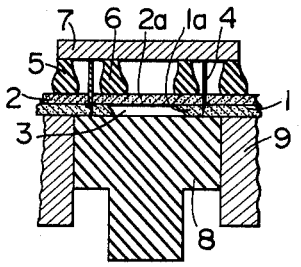
FIGS. 1–4 illustrate in section the sequence of operations of an apparatus for practicing a first example of a patch mending method according to the present invention.
Figure 2:
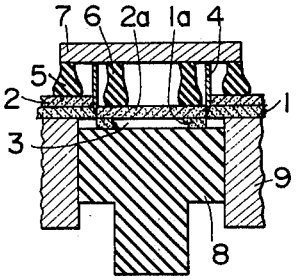
Figure 3:
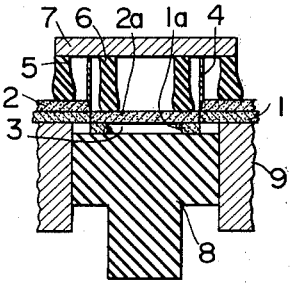
Figure 4:
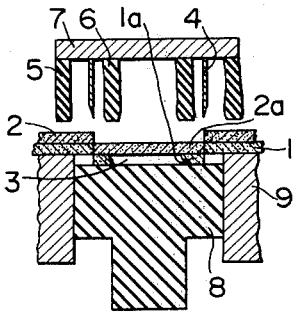

With the apparatus thus arranged, the method of the present invention will be carried out according to the sequence shown in FIGS. 1–4 to patch mend a defective veneer sheet at a pre-determined fixed spot, at any spot on a determined line or at any spot in a determined plane as desired. As viewed in FIG. 1, the patch mending head is lowered by suitable means (not shown) such that the annular cutting tool 4 integral therewith cuts through, first, a sheet of patch blank 2 and, then, a veneer sheet 1 by a single stroke of the single annular cutting tool to cut off a defective portion 1*a* from said veneer sheet and further to cut out a plug 2*a* from said sheet of patch blank 2. Then, as shown in FIG. 2, the cutter bearing body 8 is moved a distance substantially equal to the thickness of the veneer sheet 1 away from the top of its associated table 9 which is supporting the veneer sheet and patch blank. Now pressed by the member or members 6 inside the tool 4, the cut-off portion 1*a* of the veneer sheet and the cut portion or plug 2*a* of the patch blank are lowered to the position indicated in FIG. 2 where the plug 2*a* becomes substantially flush with the balance of the veneer sheet 1 outside the annular cutter 4. In this way, the plug 2*a* is pressed toward a plane in which the veneer sheet 1 extends and shifted into it while the cut-off defective portion is pushed out of the veneer sheet. The annular cutter 4 is removed, thereafter, from the veneer sheet 1 and overlying patch blank 2 which is still held in the same position by the outer presser member 6 and the table 9 as illustrated in FIGS. 3 and 4, so that the veneer portion 1*a* is removed from the veneer sheet and the plug 2*a* is left in place in the veneer sheet. These patch mending operations of the coactive path mending head and cutter bearing assemblies takes place after the patch blank 2 and defective veneer sheet 1 are brought to a position between the two assemblies.

It will be seen from FIGS. 1–4 and 13 that the relationship between the patch mending head assembly and cutter bearing assembly for practicing the method of the present invention does not need any special precision. These assemblies can thus be designed, if necessary, movable through suitable means along a desired line or in a desired plane to any desired position where a defective portion of a veneer sheet is to be removed and replaced by a plug.

The sequence of operations discussed with reference to FIGS. 1–4 may be practiced by using modified cutter bearing assembly and patch mending head assembly as will be described hereinafter.

Figure 14:
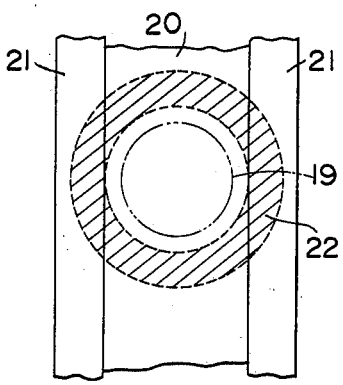
FIGS. 14 and 15 individually show in plan and section a modification to the apparatus for carrying out the first example of the invention.
Figure 15:
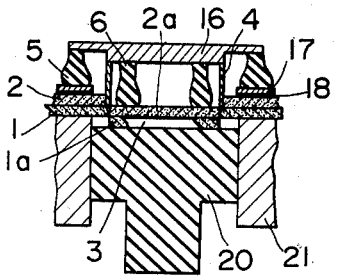

As shown in FIG. 14, the modified cutter bearing assembly comprises an elongate cutter bearing body 20 and a pair of parallel elongate table parts 21 located on the opposite sides of the cutter bearing body 20. The reference numeral 19 in FIG. 14 denotes the edge line of the annular cutter 4 and 22 the annular zone in which the outer presser member or members will press the patching blank 2 underlying veneer sheet 1. The modified patch mending head assembly coactive with the cutter bearing assembly is shown in FIG. 15 and includes an outer presser member or members 5 essentially similar to those of FIGS. 1–4 except for the additional provision of a steel plate 17 and a thin rubber layer 18 thereon. To match with such modification to the cutter bearing assembly, a slightly modified flat holder 16 is provided to the patch mending head assembly. The modification to the patch mending head assembly is applied for the following reasons in correspondence with the modification to the cutter bearing assembly.

The coactive assemblies depicted in FIGS. 14 and 15 are driven for patch mending a defective veneer sheet in the manner shown in FIGS. 1–4. When the cutter bearing body 20 is moved to the position of FIG. 2 after the annular cutting tool 4 has cut the veneer sheet 1 and patch blank 2 together, the outside flexible rubber member 5 would also sag and press the veneer sheet downward and patch blank outside the annular cutter in an area which is not supported by elongate tables 21. This prevents the desired shift which makes the plug 2*a* inside the cutter 4 substantially flush with the veneer sheet 1 outside the cutter 4. The steel plate 17 shown in FIG. 15 is adhered or secured to the rubber member 5 having an elastic and sectional pressing function so that the latter is displaceable in unison to press the overlaid flat materials outside the annular cutter 4. More specifically, the provision of the steel plate 17 ensures that a part of the presser member 5 in the area where the tables 21 are absent is displaceable in perfect unison with the remainder where the tables 21 are present. The steel plate 17 in this way prevents the presser member 5 from accidentally moving the veneer sheet 1 and patch blank 2 downward in the regions outside the annular cutter 4, ensuring the intended downward shift of the routed cut portion 1*a* and plug 2*a*. The thin rubber layer 18 increases the friction force thereby avoiding damage to the patch blank 2 and/or veneer sheet 1 when the cutter 4 cuts them together.

These modified cutter bearing assembly and patching head assembly constitute in combination an apparatus which is desirably operable for patch mending at spots on a selected line or linear patching. The patch mending head assembly mounted to the holder 16 is suitably movable along the elongate cutter bearing body 20 and, at a desired location, driven as indicated in FIGS. 1–4 for patch mending the defective veneer sheet 1. If desired, the two coactive assemblies may be made integrally movable perpendicular to the elongate cutter bearing body 20 so as to facilitate the patch mending operation at desired spots in a selected plane or planar patching.

It will be understood that the above-described alternative design of the outer presser member is applicable also to those formed of rubber along in the arrangement shown in FIG. 13.

Turning to FIGS. 5–8, there will be described another example of the patch mending method according to the present invention.

As will be seen from the drawings, not the veneer sheet 1 but the patch blank 2 is fed in this case onto the cutter bearing assembly in contrast to the sequence shown in FIGS. 1–4. In other words, the veneer sheet 1 is laid upon the patch blank 2. The apparatus for practicing this method comprises a cutter bearing assembly made up of a cutter bearing body 11 and a pressing head 10 surrounded by the cutter bearing body 11 and movable upward into the annular cutter 4. A patch mending head assembly to cooperate with the cutter bearing assembly has the same construction as that employed for the operations of FIGS. 1–4.

Figure 5:
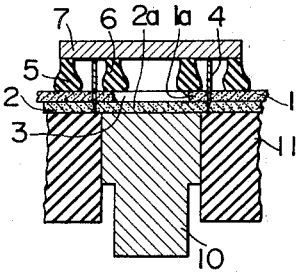
FIGS. 5–8 show in section the sequence of operations of an apparatus for practicing a second example of the method according to the present invention.
Figure 6:
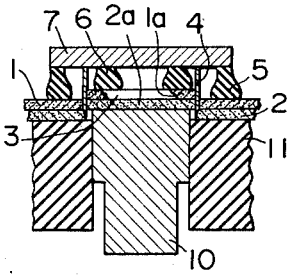
Figure 7:
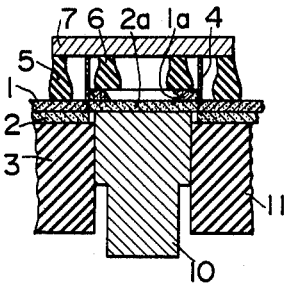

First, the patch mending head assembly is brought downward as viewed in FIG. 5 by suitable means to cut, first, the defective veneer sheet 1 to cut off the defective portion 1*a* and, then, cut the underlying patch blank 2 to cut out a plug 2*a* by means of a single annular cutting tool 4. Then the pressing head 10 is raised to the position shown in FIG. 6 to shift the now cut defective portion 1*a* and plug 2*a* upward a distance substantially equal to the thickness of the veneer sheet 1 until the plug 2*a* becomes substantially flush with the balance of the veneer sheet outside the annular cutter 4. The annular cutter 4 is removed from the overlaid materials while the inner and outer presser members 6 and 5 are maintaining the shifted relation of the defective portion and plug. The defective portion 1*a* is thus removed from the veneer sheet 1 and the plug 2a is seated in the resulting hole.

Another example of the patch mending method according to the invention will be described with reference to FIGS. 9–12.

In FIGS. 9–12, the patch blank 2 is laid on the cutter bearing assembly as in the process discussed in conjunction with FIGS. 5–8. The cutter bearing assembly employed for this patch mending method consists solely of flat cutter bearing body 15. The patch mending head assembly replaces the inner presser member by a positioning head 13 which is located inside the annular cutting tool 4 as viewed in the drawings and provided with a positioning member 12. The annular cutter 4 has a frustoconical inner wall at its edge portion which diverges to the lower most end as illustrated. This type of patch mending apparatus will be operated as follows.

Figure 9:
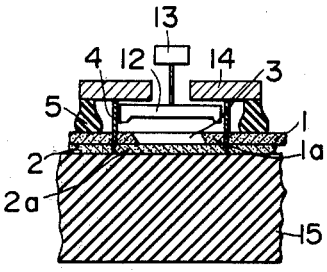
FIGS. 9–12 show the sequential operations of an apparatus for practicing a third example of the method of the present invention.
Figure 10:
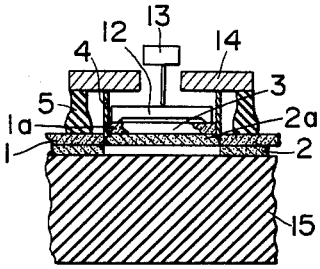
Figure 12:
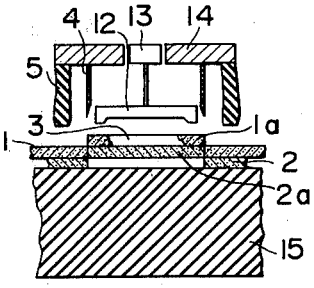

The patch mending head assembly is first lowered to the position shown in FIG. 9 so that its associated annular cutter 4 cuts through, first, the veneer sheet 1 to cut off the defective portion 1a and, then, the patch blank 2 to cut out a plug 2a. Then, as viewed in FIG. 10, the cutting tool 4 withdraws from the stacked stock and pulls upwards the cut defective portion 3 and plug 2a while pinching them therein until the positioning member 12 stops the upward movement of the defective portion and plug. Such a shift makes the plug 2a substantially flush with the plane in which the veneer sheet 1 extends outside the annular cutter 4. The upward shift of the defective portion 3 and plug 2a is enabled in this example by the single-edged and inwardly inclined edge portion of the annular cutter 4. An alternative arrangement of so raising the defective portion 3 and plug 2a may be by suction with the vacuum which will develop inside the cutter 4 or by, needle-like members provided to the holder 14 such that they thrust into the two cut pieces and raise them in accordance with the subsequent upward stroke of the holder 14, or the combination of the suction and needle-like members.

Figure 11:
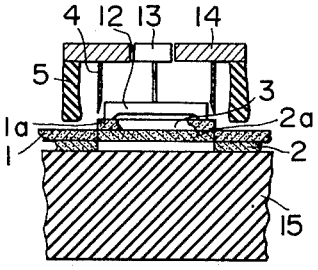

Then, as shown in FIG. 11, despite a further movement of the cutter 4 away from the stacked stocks, the positioning member 12 holds the plug 2a in the same position at earliest until the effort exerted by the cutter 4 to raise the plug 2a is lost. Thereafter, the positioning member 12 is moved upward together with the cutter 4 to the position shown in FIG. 12 away from the routed out veneer portion 1a and plug 2a. The apparatus in this way routes out the defect 3 from the veneer sheet 1 and fills the routed-out hole of the veneer sheet with the plug 2a in the same sequence.

It will be seen from the three different examples described above that in one aspect the present invention provides a patch mending method which consists in laying a patch blank 2 on a portion of a veneer sheet 1 including a defect 3, cutting the defective portion of the veneer sheet and a superimposed part of the patch blank with an annular cutter 4, shifting the cut-off defective portion and plug together in thicknesswise direction to make the patch 2a inside the cutter 4 substantially flush with the balance of the veneer sheet outside the cutter 4 with the cutter 4 serving as a guide, and drawing out the cutter 4 while holding the shifted positions of the defective portion and plug to leave the plug in the resulting hole of the veneer sheet. This simultaneous removal of a defect and replacement thereof with a patch affords an outstanding advantage that the shape of a plug cut from a patch blank is always identical with that of a hole of a veneer sheet resulting from the removal of a defect. Another outstanding advantage lies in that seating of a plug proceeds using the annular cutter essentially as a guide and, thus, completes favorably with incomparable positiveness. Stated another way, the method of the present invention achieves precise coincidence in shape and size of a patch with a resultant hole in a veneer sheet and sure insertion of the patch in the hole, which have constituted major targets to be attained in the art of veneer sheet patch mending, by cutting a veneer sheet and a patch blank with a single cutter and seating a plug with a guide afforded by the cutter as described.

Utilizing the same principle, the present invention can also be embodied as a further example of the patch mending method which will be described hereinafter.

Figure 16:
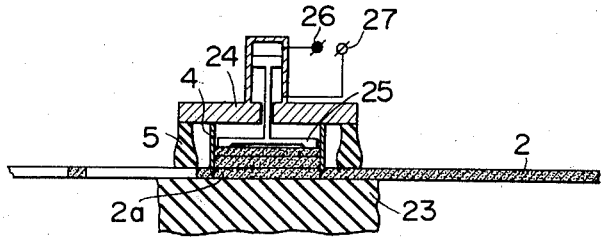
FIGS. 16–20 show the sequential operations of an apparatus for practicing a fourth example of the method of the present invention.

Referring to FIGS. 16–20, there are shown an apparatus and its sequence of operations for practicing the further example of the present invention. Briefly described, the illustrated method includes the steps of cutting a suitable number of plugs 2a from a common patching blank 2 and holding them inside the annular cutter 4 in stacked relation as seen in FIG. 16, and patching plural defects successively by supplying the plug 2a one by one from the patch stack as seen in FIGS. 17–20.

The patch mending apparatus includes the outer presser member 5 outside the annular cutting tool 4 and an inner presser member 25 inside the same. The inner presser member 25 is integral with a piston which is associated with a holder 24. Ports 26 and 27 are provided to the apparatus for selective communication of a fluid under pressure to the cylinder of the holder 24. The reference numeral 23 in FIG. 16 denotes a flat cutter bearing body placed at a suitable station in order to prop up the annular cutting tool 4 while patches 2a are being cut from the patching blank 2. The cutter bearing assembly for patch mending on the other hand comprises the cutter bearing body 8 and table 9 as viewed in FIGS. 17–20 which are constructed and arranged as in the cutter bearing assembly of FIGS. 1–4.

Figure 17:
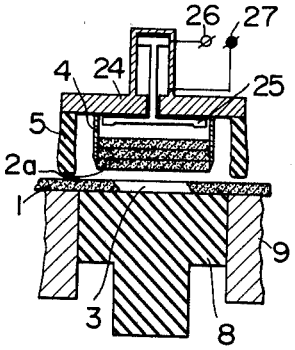
Figure 18:
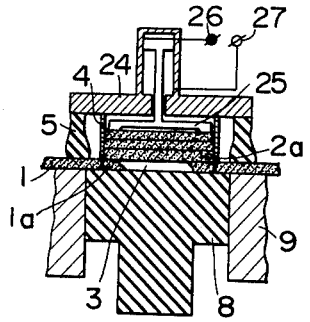
Figure 19:
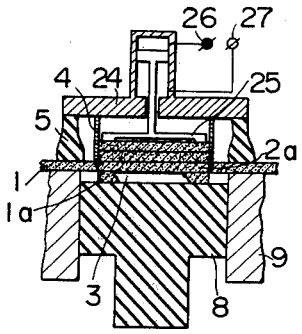
Figure 20:
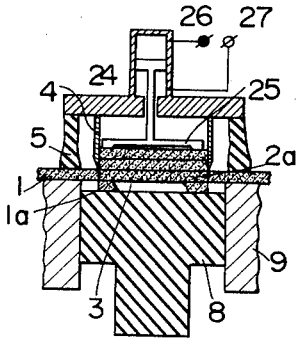

In operation, the apparatus first repeatedly cuts through a sheet of patch blank by means of a single annular cutting tool to cut out a suitable number of plugs 2a from the patch blank 2 as seen in FIG. 16 in combination with the cutter bearing body 23. As a defective portion 3 of the veneer sheet 1 arrives at the cutter bearing body 8 as seen in FIG. 17, the patch mending head assembly moves to a position where it will be ready for patch mending actions. After the plugs are produced from the blank 2, the ports 26 and 27 may be kept in a fluid-out state to depressurize the cylinder of the holder 24 and maintain the pressure acting on the inner presser member 25 low so that the annular cutter can frictionally retain the plugs 2a thereinside. It will be noted, however, that it is preferable to admit the pressurized fluid into the cylinder solely through the port 26 when the cutter 4 cuts into the blank 2 on the body 23 because the fluid pressure then acting on the member 25 will prevent the breakage of a plug 2a being cut from the blank. The patch mending head is lowered to the position shown in FIG. 18 to cut a part of the veneer sheet including the defect 3 by means of the annular cutting tool 4 which now carries a stack of plugs 2a thereinside. These plugs are pushed farther into the cutting tool by the cut-off defect. During this downward cutting stroke of the patch mending head, the port 26 is preferably actuated to its fluid-in state and the port 27 to its fluid-out state for thereby pushing the inner presser member 25 downward within the cutting tool 4 such that the inner presser member 25 presses the plugs toward a plane in which the veneer sheet extends. Then the body 8 of the cutter bearing assembly is moved downward a distance substantially equal to the thickness of the veneer sheet 1 relative to the table 9 as indicated in FIG. 19 whereby the defect 3 and patch stack within the cutter 4 are shifted bodily downward by the presser member 25 until the lower-most plug *2a* becomes substantially flush with the remainer of the veneer sheet 1 outside the cutter. In other words, one of the pushed-in plugs is shifted into the plane in which the veneer sheet extends while pushing the cut-off defect from the plane. Thereafter, the cutter 4 is drawn out from the veneer sheet 1 as shown in FIG. 20 while the inner and outer presser member 25 and 5 holding the conditions indicated in FIG. 19. The port 26 will change its state from the fluid-in to the fluid-out about the time when the edge of the cutter 4 rises clear of the veneer sheet 1 and, at the same time, the port 27 will be actuated to its fluid-in state. As will be noted, the black dots and white dots in the drawing indicate the fluid-in and fluid-out states of the ports 26 and 27, individually.

Eventually, the lowermost plug *2a* is fed out from the stack inside the annular cutter 4 and left in the veneer sheet 1 to replace the removed portion *1a*.

It will be appreciated from FIGS. 16–20 that in another aspect the present invention provides a method which consists of cutting plugs *2a* from a patch blank 2 with an annular cutter 4 and retaining them as a stack inside the cutting tool 4, cutting a defective portion of a veneer sheet with the annular cutter, shifting the patch stack and defective cut portion employing the cutter as a guide until the lowermost plug *2a* becomes substantially flush with the balance of the veneer sheet outside the cutter 4, and removing the cutter from the veneer sheet while holding the shifted condition of the lowermost plug *2a* and pushed-out defective portion *1a*, thereby leaving the plug *2a* in the veneer sheet in place of the removed defective portion. Apart from the advantages already discussed, this alternative process promotes concentrated high-speed patching operations on a defective veneer sheet because it can patch multiple defects in the veneer sheet successively without supplying a patch blank for each defect until the stack of plugs *2a* in the annular cutter runs out. It will be understood that the apparatus shown in FIGS. 16–20 can also be modified as already described to patch a defective veneer sheet along a selected line or in a selected plane.

While the present invention has been shown and described in connection with some preferred examples thereof, various changes and modifications may be made without departing from the principle and scope of the present invention.

A plug in the examples shown and described has been made substantially flush with the balance of a defective veneer sheet outside the annular cutter by shifting the materials inside the cutting tool 4 relative to those outside the cutting tool 4. The flush position may occur in a curved plane depending on the manner of holding a a veneer sheet outside the cutter. More specifically, where a veneer sheet is retained in a suitable curved plane, a plug inside the cutter will be shifted relative to a patch blank such that it is contained in the common curved plane. In other words, the flush position concerned may occur either in a flat plane or in a curved plane in matching relation with the plane which will contain a veneer sheet.

While the actions of the apparatus in each example have concentrated on the downward movement of the patch mending head assembly, it will be noted that the cutter bearing assembly may be moved upward instead or the vertical positional relationship between the patch mending head assembly and cutter bearing assembly may be inverted and moved relative to each other.

The circular cutting edge of the annular cutting tool 4 is not limitative but only illustrative. Besides various other possible configurations, the cutter 4 may comprise of a strip of thin replaceable edge or bit 28 shown in FIG. 21 which is curved and has some gap 29 defined between its opposite ends.

After a plug has been seated in a defective veneer sheet, a secondary mending operation may be performed with a tape, an adhesive or the like if desired.

In summary, the present invention provides a veneer patch mending method which contributes a great deal to the industry by promoting positive and reliable patching on veneer sheets and building up the foundation of a linear, planar or like efficient patch mending technique.

What is claimed is:

1. A method of patch mending a veneer sheet comprising the steps of (1) laying a veneer sheet having a defective portion and a sheet of mending material one on top of the other;

(2) cutting through said veneer sheet and said sheet of mending material by a single stroke of a single annular cutting tool to cut off said defective portion from said veneer sheet and further to cut out a plug from said sheet of mending material;

(3) shifting said plug into a plane in which the veneer sheet extends while removing said cut-off defective portion from said veneer sheet; and (4) removing said annular cutting tool from said sheet of mending material and said veneer sheet to leave said plug within the veneer sheet resulting in a patch mended veneer sheet.

2. A method according to claim 1, wherein said cutting step is performed in the sequence of first the sheet of mending material and then the veneer sheet.

3. A method according to claim 2, wherein said shifting step includes a step of pressing the plug toward the plane in which the veneer sheet extends.

4. A method according to claim 1, wherein said cutting step is performed in the sequence of first the veneer sheet and then the sheet of mending material.

5. A method according to claim 4, wherein said shifting step includes a step of pressing the plug toward the plane in which the veneer sheet extends.

6. A method according to claim 4, wherein said shifting step includes a step of pinching the plug by said annular cutting tool and pulling the pinched plug toward the plane in which the veneer sheet extends.

7. A method of patch mending a veneer sheet comprising the steps of (1) cutting through a sheet of mending material by means of a single annular cutting tool to cut out a plug;

(2) removing said single annular cutting tool from the mending material while leaving said plug within the cutting tool;

(3) cutting through a veneer sheet having a defective portion by means of said single annular cutting tool to cut-off said defective portion from said veneer sheet while pushing said cut-out plug within the cutting tool toward said defective portion;

(4) shifting said pushed-in plug into a plane in which the veneer sheet extends while removing the cut-off defective portion from said plane; and (5) removing the annular cutting tool to leave the plug in place resulting in a patch mended veneer sheet.

8. A method according to claim 7, in which said steps of (1) and (2) are repeated a plural number of times.

9. A method according to claim 7, in which said shifting step includes a step of pressing the plug toward said plane in which the veneer sheet extends.

* * * * *